US005121865A

United States Patent [19]

Howard

[11] Patent Number: 5,121,865

[45] Date of Patent: Jun. 16, 1992

[54] BELT HOLSTER FOR AUDIO-CASSETTE PLAYER

[76] Inventor: Edward T. Howard, 2021 Atwater Street, Apt. 807, Montréal, Québec, Canada, H3H 2P2

[21] Appl. No.: 731,649

[22] Filed: Jul. 17, 1991

[51] Int. Cl.[5] ..... A45F 5/00

[52] U.S. Cl. ..... 224/253; 224/240; 455/100; 24/3 R; 24/306

[58] Field of Search ..... 224/195, 224, 226, 235, 224/236, 237, 240, 250, 253, 901; 455/100, 344; 206/314; 24/306, 3 R, 3 F, 115 G; D3/100, 104

[56] References Cited

U.S. PATENT DOCUMENTS

| | | | |
|---|---|---|---|
| D. 203,101 | 12/1965 | Holder | 224/250 X |
| 4,044,932 | 8/1977 | Harris | 224/253 X |
| 4,073,416 | 2/1978 | McComber | 455/100 X |
| 4,234,116 | 11/1980 | Myers | 224/250 |
| 4,236,658 | 12/1980 | Kallman | 224/250 |
| 4,393,550 | 7/1983 | Yang et al. | 24/115 G X |
| 4,420,104 | 12/1983 | DiIenno | 224/250 |
| 4,569,465 | 11/1984 | O'Farrell | 224/224 |
| 4,620,653 | 11/1986 | Farrell | 224/253 X |
| 4,764,962 | 8/1988 | Ekman et al. | 224/901 X |
| 4,775,083 | 10/1988 | Burger et al. | 224/240 X |
| 4,811,466 | 3/1989 | Zubli | 24/115 G |
| 4,817,250 | 4/1989 | Kurosaki | 24/115 G |
| 4,972,981 | 11/1990 | Gex | 224/214 |
| 4,982,885 | 1/1991 | Severson et al. | 224/253 |
| 5,083,692 | 1/1992 | Treese | 224/250 X |

*Primary Examiner*—Henry J. Recla
*Assistant Examiner*—Glenn T. Barrett
*Attorney, Agent, or Firm*—Pierre Lespérance

[57] ABSTRACT

The belt-carried holster includes a slitted back plate engaged by a waist belt. Two pairs of complementary hook and loop flexible fastener strips are connected to the back plate and interconnected in pairs in cross-overlapping fashion, for containment of a cassette player against the back plate. At least some of the fastener strips are connected indirectly to the back plate, via flexible cords, which may be slightly elastic.

9 Claims, 2 Drawing Sheets

BELT HOLSTER FOR AUDIO-CASSETTE PLAYER

FIELD OF THE INVENTION

The invention relates to holsters for carrying a portable audio cassette player of the so-called "Walkman" type to the waist belt of a wearer.

BACKGROUND OF THE INVENTION

Body attached belt carried cases are already used for transporting on a wearer's body limb mobile communication devices, such as the so-called Walkman audio-cassette player connected to the wearer's ear by an earphone wire. These carrying cases may consist, as illustrated in U.S. Pat. No. 4,420,104 issued in 1983 to Dilenno, of a number of hook and loop fastener strips arranged orthogonally with one another for containment of the cassette player against the body belt. A disadvantage of these hook and loop fastener strips is that, to be effective, they should have a certain width. This in turn means that a large portion of the exterior wall surface of the cassette player casing is concealed by the fabric of these fastener strips, wherein the latter will hinder access to control knobs on the cassette player by the wearer. Consequently, the wearer has to remove the cassette player from the holster each time he needs to use the controls of the cassette player for e.g. modifying the sound intensity, changing the frequency, etc. This is of course undesirable.

OBJECTS OF THE INVENTION

The gist of the invention is to provide a belt-carried cassette player holster, which keeps all control knobs of the cassette player free of access by the wearer, whereby the wearer will be able to operate all control knobs while the cassette player still remains within the holster.

SUMMARY OF THE INVENTION

In accordance with the objects of the invention, there is disclosed a belt-carried holster including a slitted back plate engaged by a waist belt. Two pairs of complementary hook and loop flexible fastener strips are connected to the back plate and interconnected in pairs in cross-overlapping fashion, for containment of a cassette player against the back plate. At least some of the fastener strips are connected indirectly to the back plate, via flexible cords, which may be slightly elastic.

More particularly, the invention relates to a holster for use in releasably attaching a portable audio-cassette player to a wearer's waist belt, said player defining a casing having a top wall, a bottom wall, two opposite lateral walls, and outer and inner walls; said holster comprising: (a) a backing member, destined to be applied against the waist belt of a person; (b) securing means, integral to said backing member for releasably attaching the latter to said waist belt; (c) first loop means, integral to said backing member for use in surroundingly engaging said player casing lateral walls and outer walls for containing the cassette player and for applying said player casing inner wall against said backing member, and consisting of first and second releasably interconnected attachment members; said first attachment member defining a first pair of cord members, endwisely depending at their inner ends from a first edge section of the backing member, and a first connecting strip, endwisely depending from the outer section of said first cord members; said second attachment member defining a second pair of cord members, endwisely depending at their inner ends from a second edge section of the backing member opposite said first edge section thereof, and a second connecting strip, endwisely depending from the outer section of said second cord members; each of said first and second connecting strips having complementary adhesive surfaces, for releasable interengagement therebetween; (d) second loop means, integral to said backing member for use in both surroundingly engaging said player casing top and bottom walls and outer wall and for reinforcing said first loop engagement around said cassette player; and (e) adjustment means, integrally mounted to at least one of said first and second loop means for adjusting the overall inner diameter encompassed within their loop, to permit adaptation of said holster to cassette players having a variety of casing dimensions.

The cord members, instead of or concurrently with being used as part of the first loop means, could be incorporated into the second loop means whereby the latter would consist of first and second releasably interconnected attachment members. In this case, the latter said first attachment member would define a first connecting strip, endwisely depending from a third edge section of said backing member; while the latter said second attachment member would define a pair of cord members, endwisely depending at their inner ends from a fourth edge section of the backing member opposite said third edge section thereof, and another connecting strip, endwisely depending from the outer section of said cord members; each of the latter connecting strips having complementary adhesive surfaces for releasable interengagement therebetween.

DETAILED DESCRIPTION OF THE INVENTION

Figure 1:
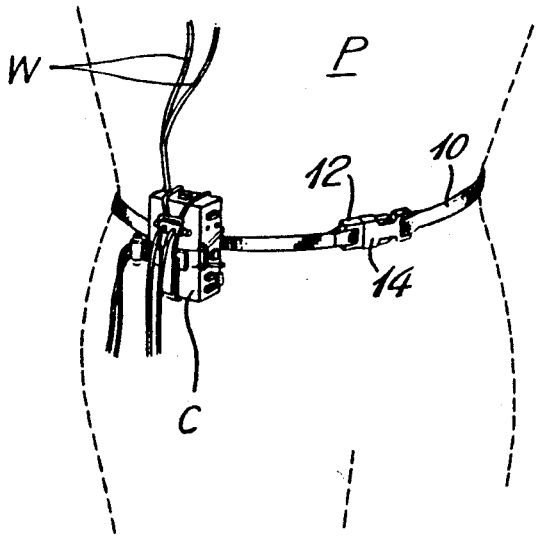
FIG. 1 is an elevational view of the waist portion of a person, illustrated in phantom lines, and of a waist belt and associated holster mounted cassette player of the invention, in full lines.
Figure 2:
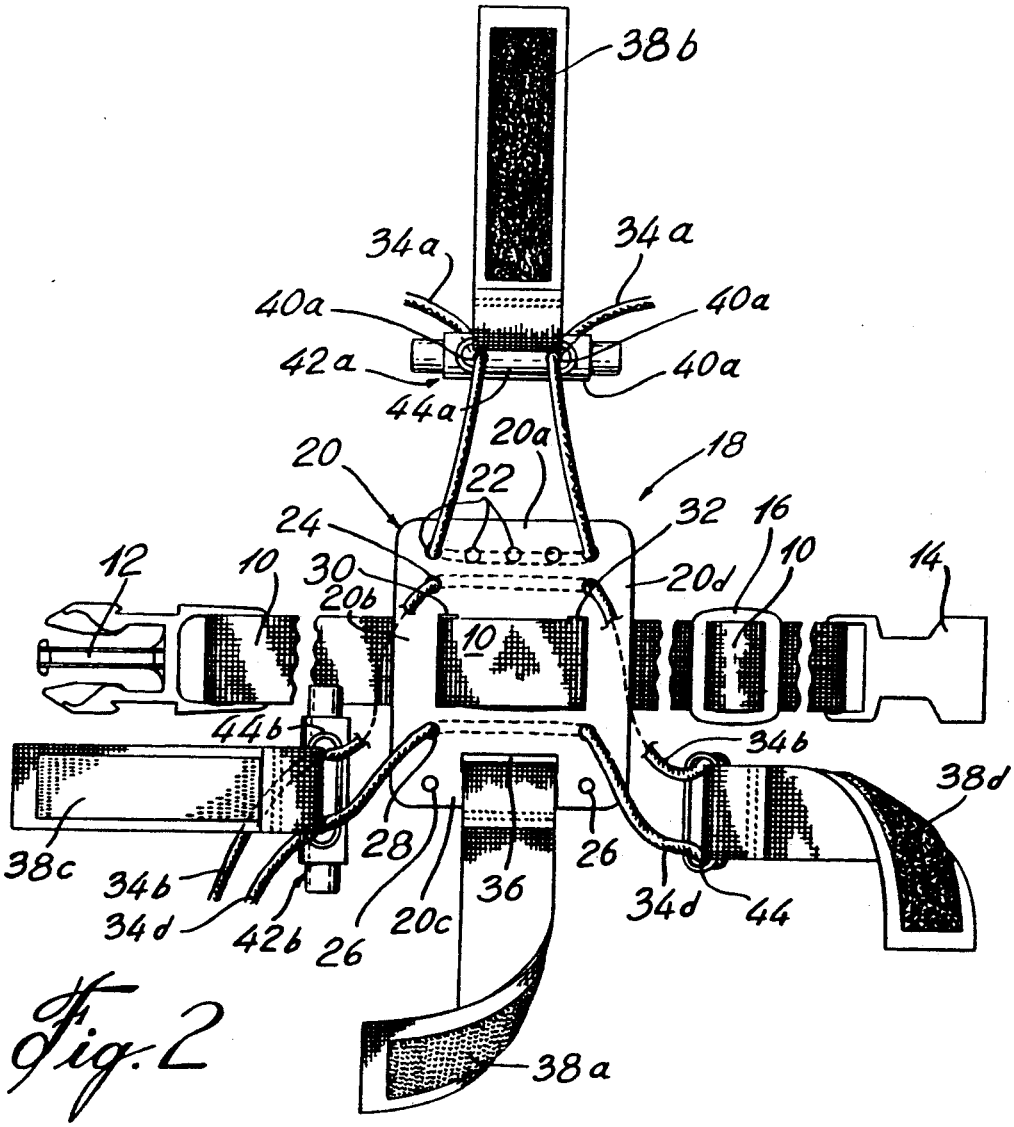
FIG. 2 is an outer plan view of the holster and belt combination.
Figure 4:
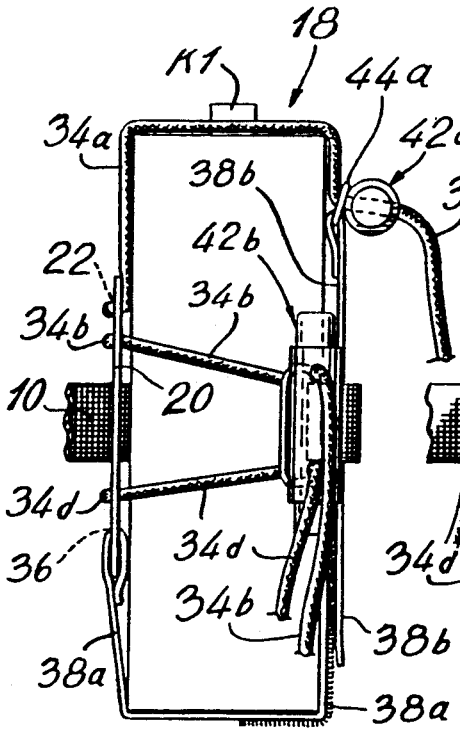
FIG. 4 is an edge view thereof.
Figure 3:
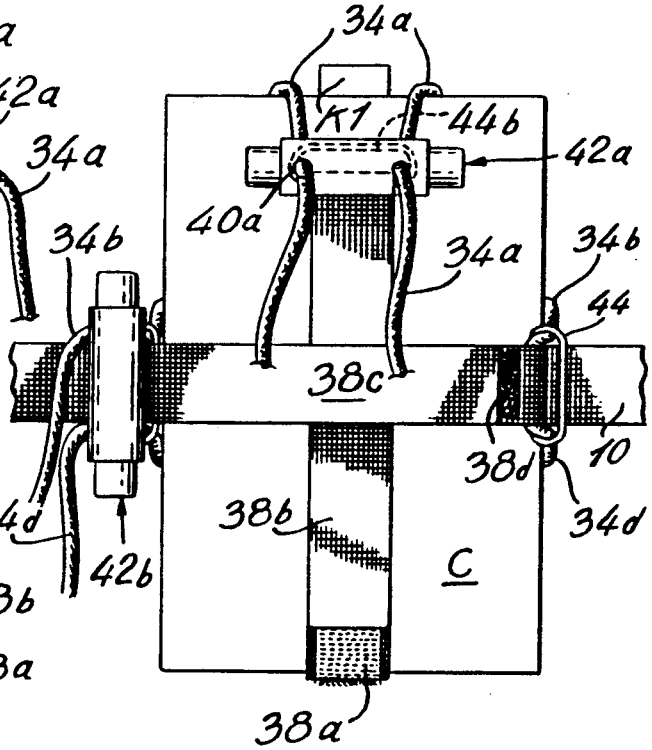
FIG. 3 is a partly broken inner plan view thereof.
Figure 5:
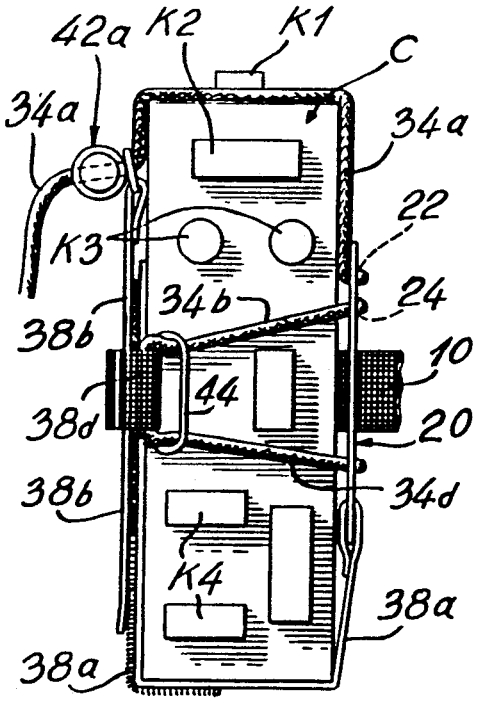
FIG. 5 is the view of FIG. 4, but further including the cassette player.

Waist belt 10 is secured around the waist of person P by conventional releasable endwise engagement of male member 12 into female member 14. A buckle 16 adjusts the overall length of belt 10 to fit various waist dimensions.

Holster 18 is for use in securing an audio cassette player C to waist belt 10. Holster 18 consists of a large quadrangular panel 20 made from a semi-rigid material, e.g. a tough leather. Quadrangular backing 20 defines four successive edge portions 20*a* to 20*d*. Each one of the opposite edge portions 20*a*, 20*c* includes two rows of a number of colinear small through-bores 22, 24 and 26, 28 respectively. Each one of the other opposite edge portions 20*b*, 20*d* includes a slit 30, 32 respectively, in transversely facing register. Slits 30, 32 are slidingly engaged by belt 10 to secure panel 20 flatly against the waist P. Through bores 22, 24 and 28 are in turn to be engaged by a plurality of cords 34*a*, 34*b*, 34*d* respectively. Edge portion 20*c* further includes a slit 36, located in between rows of bores 26, 28 and extending orthogonally to slits 30, 32. A first hook and loop fastener strip 38 is endwisely anchored to panel portion 20*c* through slit 36.

The pair of cords 34*a*, 34*a* engage the corresponding pair of transverse through-bores 40*a*, 40*a* of the tubular casing of a first barrel type cord adjuster 42*a* of conventional make. A second hook and loop fastener strip 38*b*, is endwisely anchored to adjuster 42*a*, and is adhesively complementary to fastener strip 38*a* for releasable interengagement thereof.

The two cords 34*b*, 34*b* on the panel edgewise section 20*b* engage the tubular casing of a second barrel type cord adjuster 42*b*, in a way similar to that of adjuster 42*a*. A third hook and loop fastener strip 38*c* is endwisely anchored to second adjuster 42*b*. The other two cords 34*b*, 34*d* on the panel edgewise section 20*d* are endwisely anchored to a buckle 44. A fourth hook and loop fastener strip 38*d* is endwisely anchored to buckle 44, and is adhesively complementary to third fastener strip 38*c* for releasable interengagement therewith.

It can now be understood that cords 34*a*, 34*b*, 34*d* are used around the top and sides of the housing of the cassette player C to clear passage for various cassette player push-buttons or other control knobs—such as K1, K2, K3, K4, etc. as well as for passage of earplug wire connector W. Also, barrel type cord adjusters 42*a*, 42*b* and the adhesively complementary pairs of hook and loop fasteners 38*a*, 38*b* and 38*c*, 38*d*, provide means for adjustment of the overall volume encompassed by same, in view of adjustably accommodating cassette player C of a variety of dimensions. Side cords 34*b*, 34*b* adjustably overlap across the front of the cassette player C. Thus, holster 18 including all cords 34 and fasteners 38 constitute a substantially open, cassette player containment frame.

I claim:

1. A holster for use in releasably attaching a portable audio-cassette player having control knobs to a wearer's waist belt, said player defining a casing having a top wall, a bottom wall, two opposite lateral walls, and outer and inner walls; said holster comprising:

(a) a backing member adapted to be mounted to, the waist belt of a person;

(b) securing means, integral with said backing member, for releasably attaching said backing member to said waist belt;

(c) first loop means, attached to said backing member, for surroundingly engaging said lateral walls and said outer wall of said casing and for mounting said player casing inner wall against said backing member, said first loop means consisting of first and second releasably interconnected attachment members; said first attachment member having a first pair of flexible cord members, each cord member of said first pair of flexible cord members having an inner end and an outer end, wherein said inner ends are attached to and extend from a first edge section of the backing member, and a first flexible connecting strip, said strip being attached to and extending from the outer ends of said first pair of cord members; said second attachment member having a second pair of flexible cord members, each cord member of said second pair of flexible cord members having an inner end and an outer end, wherein said inner ends of said second pair are attached to and extend from a second edge section of the backing member opposite said first edge section thereof, and a second flexible connecting strip, said strip being attached to and extending from the outer ends of said second pair of cord members; each of said first pair of and second connecting strips having complementary adhesive surfaces, for releasable interengagement therebetween;

(d) second loop means, attached to said backing member, for surroundingly engaging said top, bottom and outer walls of said casing and for reinforcing said first loop means engagement around said cassette player; and (e) adjustment means, integrally mounted to at least one of said first and second loop means for adjusting at least one of said first and second loop means, to permit adaptation of said holster to cassette players having a variety of casing dimensions;

wherein all control knobs of the cassette player remain unhindered by the holster so as to permit free access of said control knobs by the wearer.

2. A holster as defined in claim 1, wherein said adhesive complementary surface of each connecting strip is of the hook and loop type.

3. A holster as in claim 1, wherein said cord members are slightly elastic.

4. A cassette player holster as defined in claim 1, wherein said first pair of cord members are formed from two legs of a single cord which extend through two spaced channels in said first edge section of said backing member, and said second pair of cord members are similarly formed from two legs of a second single cord which extend through two other spaced channels in said second edge section; said adjustment means consisting of a barrel-type cord adjuster having a tubular member having two transverse through-bores which frictionally engage the outer ends of said first cord members, said second cord members being anchored by anchor means to the second connecting strip.

5. A holster as defined in claim 4, wherein said two spaced channels in said first edge section are located on opposite sides of said waist band when said band is secured to said backing member and said two spaced channels in said second edge are located on opposite sides of said waist band when said band is secured to said backing member such that said first and second loop means span the cassette player in crossed overlapping fashion above said waist band.

6. A holster for use in releasably attaching a portable audio-cassette player having control knobs to a wearer's waist belt, said player defining a casing having a top wall, a bottom wall, two opposite lateral walls, and outer and inner walls; said holster comprising:

(a) a backing member adapted to be mounted to the waist belt of a person;

(b) securing means, integral with said backing member, for releasably attaching said backing member to said waist belt;

(c) first loop means, attached to said backing member, for surroundingly engaging said lateral walls and said outer wall of said casing and for mounting said player casing inner wall against said backing member;

(d) second loop means, attached to said backing member, for surroundingly engaging said top, bottom and outer walls of said casing and for reinforcing said first loop means attachment around said cassette player, said second loop means consisting of first and second releasably interconnected attachment members; said first attachment member having a first flexible connecting strip attached to and extending from a first edge section of said backing member; said second attachment member having a pair of flexible cord members, each cord member having an inner end and an outer end, wherein said inner ends are attached to and extend from a second edge section of the backing member opposite said first edge section thereof, and a second flexible connecting strip, said second strip being attached to and extending from the outer ends of said cord members; each of said first and second connecting strips having complementary adhesive surfaces for releasable interengagement therebetween; and (e) adjustment means, integrally mounted to at least one of said first and second loop means for adjusting at least one of said first and second loop means to permit adaptation of said holster to cassette players of a variety of casing dimensions; wherein all control knobs of the cassette player remain unhindered by the holster so as to permit free access of said control knobs by the wearer.

7. A holster as defined in claim 6, wherein said adhesive complementary surface of each connecting strip is of the hook and loop type.

8. A cassette player holster as defined in claim 6, wherein said cord members are formed from two legs of a single cord which extend through two spaced channels in said second edge section of said backing member; said adjustment means consisting of a barrel-type cord adjuster having a tubular member having two transverse through-bores which frictionally engage the outer ends of said cord member.

9. A holster as in claim 6, wherein said cord members are slightly elastic.

* * * * *